United States Patent [19]

Canovas

[11] Patent Number: 5,016,294

[45] Date of Patent: May 21, 1991

[54] ODORLESS TOILET

[76] Inventor: Enrique A. Canovas, P.O. Box 6937, Tamuning, Guam 96911

[21] Appl. No.: 531,424

[22] Filed: May 31, 1990

[51] Int. Cl.[5] ..... E03D 9/04; A47K 13/00

[52] U.S. Cl. ..... 4/217; 4/347; 4/209 R

[58] Field of Search ..... 4/209 R, 209 FF, 210, 4/211, 213, 214, 215, 216, 217, 347, 348, 349, 350, 351, 352, 306

[56] References Cited

U.S. PATENT DOCUMENTS

| | | | |
|---|---|---|---|
| 2,309,774 | 2/1943 | Kistler | 4/213 |
| 3,534,415 | 10/1970 | Huffman | 4/213 |
| 3,740,772 | 6/1973 | Paley | 4/217 |
| 4,094,023 | 6/1978 | Smith | 4/213 |
| 4,103,370 | 8/1978 | Arnold | 4/213 |
| 4,617,687 | 10/1986 | Wadsworth | 4/213 |

*Primary Examiner*—Henry J. Recla
*Assistant Examiner*—Antoine Gamarra
*Attorney, Agent, or Firm*—Sughrue, Mion, Zinn, Macpeak & Seas

[57] ABSTRACT

A toilet and toilet seat adapter unit which can be produced at a low cost yet which provides improved sealing around the toilet seat and which is easy to clean. The toilet seat adapter unit is disposed between the toilet seat and the upper surface of the rim of the toilet bowl of a conventional toilet. The toilet seat adapter unit includes a flat plastic plate having a shape and dimension generally conforming to those of the toilet seat. The lower surface of the flat plate is placed on the upper surface of the rim of the toilet bowl. A first set of plastic clips, affixed to the lower surface of the flat plate, fits around the outer edge of the rim of the toilet bowl and prevents the flat plate from slipping on the upper surface of the rim. A flexible plastic hose is looped around the upper surface of the flat plate and held in place by a second set of plastic clips. The hose communicates with a vacuum pump or exhaust fan. The height of the second set of clips is less than the diameter of the plastic hose so that the toilet seat will slightly compress the plastic hose when in use, thereby providing a tight seal around the seat.

10 Claims, 2 Drawing Sheets

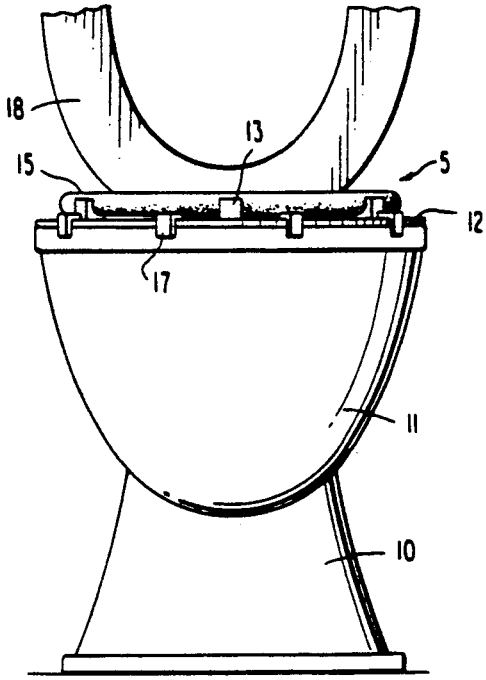
FIG. 4
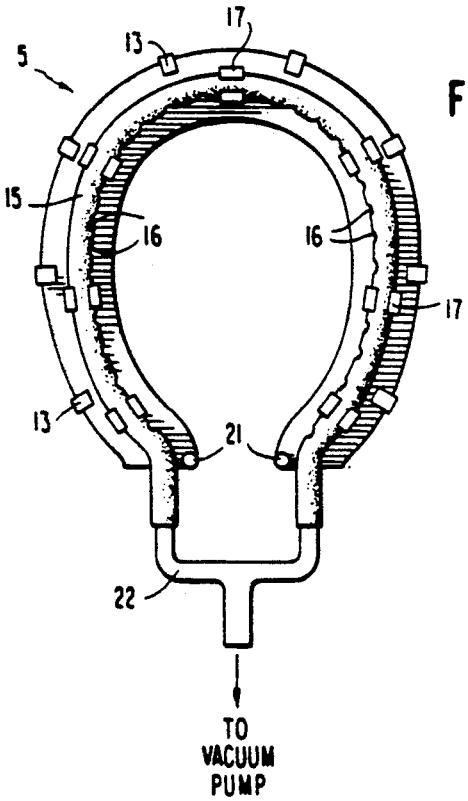
FIG. 5
FIG. 6
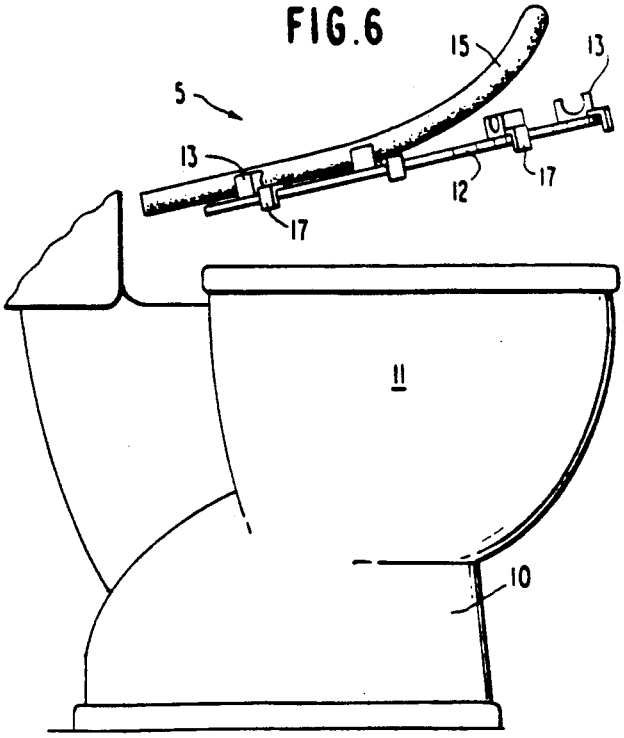

ODORLESS TOILET

BACKGROUND OF THE INVENTION

The present invention relates to an odorless toilet and a toilet seat adapter unit for removing malodorous air surrounding the toilet.

Ventilated toilet seat and toilet constructions are known which include means for ventilating malodorous air to the outside. Examples are described in U.S. Pats. Nos. 3,740,772, 4,094,023 and 4,617,687. In general, the known constructions include a suction passage provided inside the toilet seat itself. Such constructions are expensive and require a specially manufactured toilet seat. Moreover, the degree of removal of malodorous air is often less than desired due to a gap existing between the bottom of the toilet seat and the top & rim of the toilet bowl through which malodorous air can escape. Yet further, the conventional devices were often difficult to clean since the suction passage, etc., was provided inside the body of the toilet seat.

It is therefore an object of the present invention to eliminate these difficulties and to provide a toilet and toilet seat adapter unit which can be added to a standard toilet seat and which can be produced at a low cost.

It is a further object of the invention to provide a toilet and toilet seat adapter unit which can substantially & completely exhaust malodorous air from around a toilet.

It is still another object of the invention to provide such a toilet and toilet seat adapter unit which can easily be cleaned.

SUMMARY OF THE INVENTION

These as well as other objects of the present invention have been met by a toilet comprising a toilet bowl, a toilet seat, and a toilet seat adapter unit disposed between the toilet seat the upper surface of the rim of the toilet bowl. The toilet seat adapter unit includes a flat plastic plate having a shape and dimensions generally conforming to those of the toilet seat. The lower surface of the flat plate is placed on the upper surface of the rim of the toilet bowl. A first set of plastic clips, which may be molded integrally with the flat plate or affixed thereto by an adhesive or the like, is & attached to the lower surface of the flat plate around its outer edge. The first set of plastic clips fit around the outer edge of the rim of the toilet bowl and prevent the flat plate from slipping from side to side or backward and forward. The second set of clips holds in place a perforated flexible plastic hose which loops around the upper surface of the flat plate and is communicated behind the seat with a vacuum pump or exhaust fan, which may be provided in a separate compartment or room. The height of the second set of clips is somewhat less than the diameter of the plastic hose. Accordingly, the toilet z& will slightly compress the plastic hose when in use, thereby providing a tight seal around the seat.

BRIEF DESCRIPTION OF THE DRAWINGS

FIG. 4 is a front view of the toilet of FIG. 1 with the seat in the raised position;

FIG. 5 is a partial top view of the toilet seat adapter unit;

FIG. 6 is a side view of the toilet of FIG. 1 illustrating the manner in which the components of the toilet seat adapter unit can be disassembled.

DESCRIPTION OF THE PREFERRED EMBODIMENTS

Figure 1:
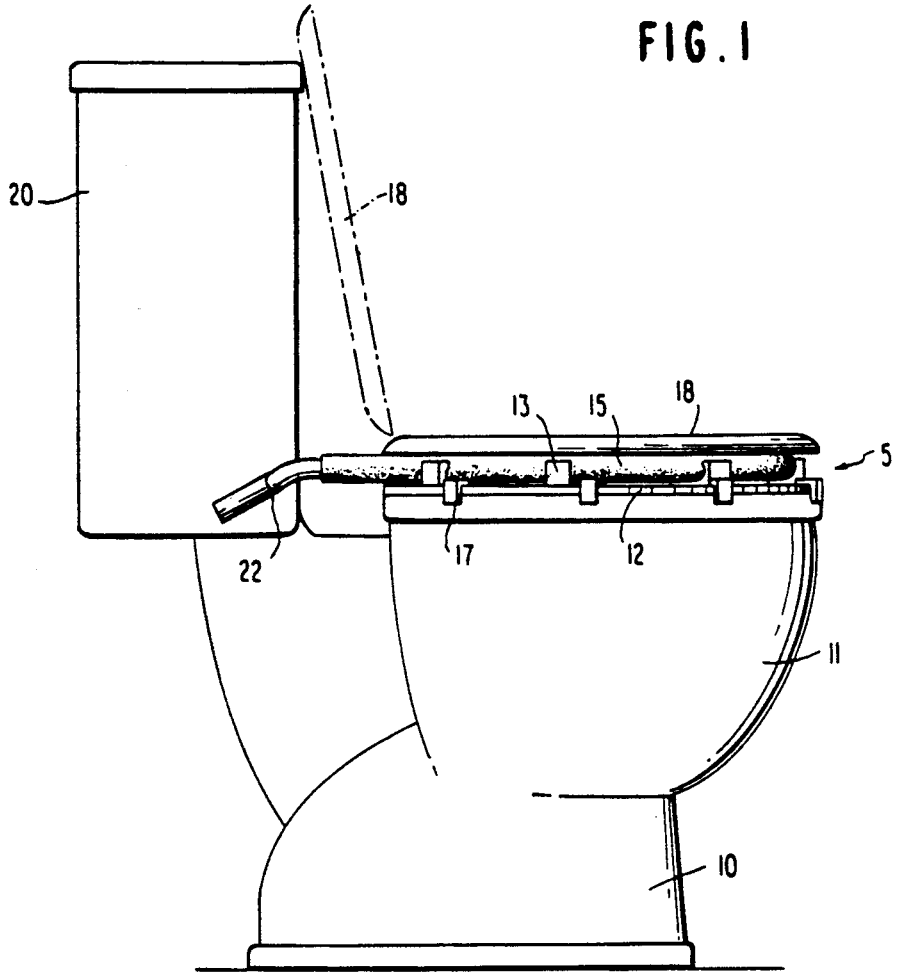
FIG. 1 is a side view of a toilet constructed in accordance with the present invention.

A preferred embodiment of a toilet and toilet seat adapter unit constructed in accordance with the present invention will be described with reference to the attached drawings.

As depicted in FIGS. 1 through 5 of the drawings, a toilet constructed in accordance with the present invention includes a toilet bowl 11, toilet bowl stand 10, tank 20 and seat 18, all of standard construction. A toilet seat adapter unit 5 is interposed between the lower surface of the seat 18 (when the seat is in its lowered position) and the upper surface of the rim of the toilet bowl 11.

Figure 2:
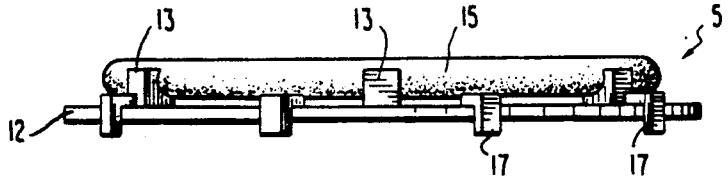
FIG. 2 is a front view of a toilet seat adapter unit used with the toilet of FIG. 1.
Figure 3:
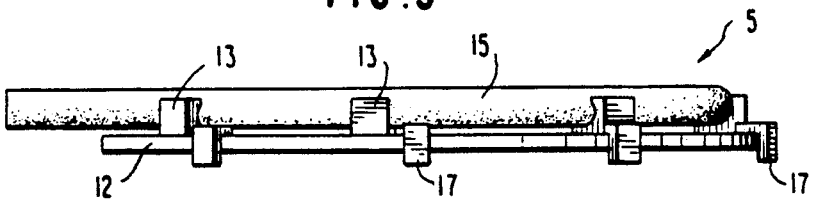
FIG. 3 is a side view of the toilet seat adapter unit.

As seen best in FIGS. 2 through 4, the toilet seat adapter unit is composed of a flat plastic plate 12 having a shape and dimensions generally conforming to a plan view of the toilet seat 18. The thickness of the plate 12 may be about one-eighth to three-sixteenth of an inch (0.32 to 0.48 cm). A first set of plastic clips 17 is affixed to the lower surface of the plastic plate 12. The clips 17, which preferably have an inverted-L shape, are positioned so as to engage the outside (vertical) surface of the rim portion of the toilet bowl 11 to thereby prevent the flat plate 12 from sliding from side to side or backward and forward. A second set of generally U-shaped plastic clips 13 is affixed to the upper surface of the flat plate 12. The clips 13 and 17 may either be molded integrally with the flat plate 12, or they may be manufactured separately therefrom and affixed to the flat plate 12 with an adhesive or the like.

Additionally, the plate 12 may, if desired, be provided with projections 21 on its upper surface which are received in corresponding cut-outs in the seat 18.

A flexible plastic perforated hose 15 is received and held in place by the second clips 13. The outer diameter of the hose 15 is preferably about one-half to one inch (1.27 to 2.54 cm). The perforations 16 (FIG. 5) of the hose 15 are directed inwardly of the seat 18. The height of the second clips 13 is somewhat less than the diameter of the flexible perforated hose 15. Accordingly, when in use the toilet seat 18 will slightly compress the hose 15 between the lower surface of the seat 18 and the flat plate 12, thereby providing a tight seal around the seat 18 so as to prevent malodorous air from escaping the toilet bowl 11.

As shown most clearly in FIG. 5, the rear ends of the hose 15 are connected through a T-section 22, to a vacuum pump or exhaust fan (not shown) of standard design. Make-up air can enter the bowl 11 in the region between the rear ends of the hose 15 at the bifurcated rear end of the seat 18. Otherwise, in an oval-shaped seat, air can enter under the seat in the space between the rear ends of the hose 15.

The toilet seat adapter unit 5 described above can be manufactured at a low cost since it employs only easily molded plastic components and a plastic hose. However, the instant invention provides more complete exhaustion of malodorous air than conventional designs due to the good seal between the toilet seat and the rim of the toilet bowl. Further, as depicted in FIG. 6, the flat plate 12 and flexible hose 15 can be readily disassembled for easy cleaning merely by lifting the hose 15 completely or partially free from the clips 13. Moreover, if the toilet bowl overflows, the thickness of the flat plate 12 prevents bowl water from being sucked into the flexible hose 15 through the perforations 16 since the water can flow over the rim of the bowl 11 at the rear of the seat 18, namely, at a level below the level of the perforations 16.

This completes the description of the preferred embodiments of the invention. Although preferred embodiments have been described, it is believed that numerous modifications and alterations thereto would be apparent to one of ordinary skill in the art without departing from the spirit and scope of the invention.

What is claimed is:

1. A toilet comprising: a toilet bowl, a toilet seat, and a toilet seat adapter unit disposed between a lower surface of said toilet seat and an upper surface of a rim of said toilet bowl, said toilet seat adapter unit comprising a substantially flat plastic plate having a shape and dimensions generally conforming to said toilet seat, a first set of plastic clips attached to a lower surface of said flat plate around an outer edge thereof and fitting around an outer edge of said rim of said toilet bowl, a second set of clips attached to an upper surface of said flat plate, and a flexible perforated hose received in said second clips, a height of said second set of clips being less than a diameter of said hose.

2. The toilet of claim 1, wherein said flat plate has a pair of projections attached to said upper surface of said flat plate, said projections being received in corresponding cutouts in said lower surface of said seat.

3. The toilet of claim 1, further comprising a T-section for connecting rear ends of said hose to a source of vacuum.

4. The toilet of claim 1, wherein said first set of clips have generally an inverted-L shape.

5. The toilet of claim 1, wherein said second set of clips have generally a U-shape to allow easy insertion and removal of said hose.

6. A toilet seat adapter unit for disposal between a lower surface of a toilet seat and an upper surface of a rim of a toilet bowl, said toilet seat adapter unit comprising: a substantially flat plastic plate having a shape and dimensions generally conforming to said toilet seat, a first set of plastic clips attached to a lower surface of said flat plate around an outer edge thereof and fitting around an outer edge of said rim of said toilet bowl, a second set of clips attached to an upper surface of said flat plate, and a flexible perforated hose received in said second clips, a height of said second set of clips being less than a diameter of said hose.

7. The toilet seat adapter unit of claim 6, wherein said flat plate has a pair of projections attached to said upper surface of said flat plate, said projections being received in corresponding cut-outs in said lower surface of said seat.

8. The toilet seat adapter unit of claim 6, further comprising a T-section for connecting rear ends of said hose to a source of vacuum.

9. The toilet seat adapter unit of claim 6, wherein said first set of clips have generally an inverted-L shape.

10. The toilet seat adapter unit of claim 6, wherein said second set of clips have generally a U-shape to allow easy insertion and removal of said hose.

* * * * *

UNITED STATES PATENT AND TRADEMARK OFFICE

CERTIFICATE OF CORRECTION

PATENT NO. : 5,016,294

DATED : May 21, 1991

INVENTOR(S) : Enrique A. Canovas

It is certified that error appears in the above-identified patent and that said Letters Patent is hereby corrected as shown below:

Col. 1, line 46, delete "&".

Col. 1, line 57, delete "z&".

Signed and Sealed this

Twentieth Day of October, 1992

*Attest:*

DOUGLAS B. COMER

*Attesting Officer*

*Acting Commissioner of Patents and Trademarks*